US006666711B2

(12) United States Patent
Takashita et al.

(10) Patent No.: US 6,666,711 B2
(45) Date of Patent: Dec. 23, 2003

(54) ELECTRICAL CONNECTOR FOR A CIRCUIT BOARD

(75) Inventors: Yoshinori Takashita, Tokyo (JP); Mitsuo Ishida, Tokyo (JP); Kazuhisa Tsunematsu, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 10/119,689

(22) Filed: Apr. 11, 2002

(65) Prior Publication Data

US 2002/0151211 A1 Oct. 17, 2002

(30) Foreign Application Priority Data

Apr. 17, 2001 (JP) ..... 2001-118175

(51) Int. Cl.[7] ..... H01R 12/24
(52) U.S. Cl. ..... 439/495
(58) Field of Search ..... 439/495, 260, 439/924.1, 79

(56) References Cited

U.S. PATENT DOCUMENTS 4,778,403 A * 10/1988 Ikesugi et al. ..... 439/495
6,162,083 A 12/2000 Seto

FOREIGN PATENT DOCUMENTS

JP 7-142130 6/1995

* cited by examiner

*Primary Examiner*—Gary Paumen
(74) *Attorney, Agent, or Firm*—Kanesaka & Takeuchi

(57) ABSTRACT

An electrical connector has a plurality of sheet-type terminals (20 and 30) which are received into corresponding receiving slots (11 and 12) of a housing (10) and are arranged parallel each other in a direction. The terminals (20, 30) have connection sections (23 and 33) at their ends, which are arranged so as to face the same side and protrude outward from a bottom surface of the housing. The movable member (40), which presses a flat cable (C) toward contact sections (26, 36), is movably supported at an open mouth of the housing (10). The connection sections (23 and 33) have connection surfaces (23A and 33A) for contact with circuit sections of a circuit board, which are staggered in a receiving direction of the terminals to the housing.

3 Claims, 5 Drawing Sheets

ELECTRICAL CONNECTOR FOR A CIRCUIT BOARD

BACKGROUND OF THE INVENTION

1. Field of the Invention

The present invention relates to an electrical connector for a circuit board.

2. Description of the Related Art

A connector of this type is disclosed in Japan patent application Kokai No. 07-142130.

In this known connector, a plurality of terminals are shaped by stamping a flat metal material maintaining its flat surfaces, and provided in a housing with certain intervals so as to be parallel to each other. The plurality of terminals are similar in their shapes, and have connection sections which protrude outward from the housing and have connection surfaces at their lower rear edges. Each terminal is connected to a circuit board by soldering each connection surface to a corresponding circuit section. In addition, each terminal has a contact section at the front end of its deflectable or flexible arm in the housing, so that a flat cable is to be placed thereon when it is inserted from an open mouth of the housing. Then, the flat cable elastically contacts with the contact section by turning a movable piece over to a closed position, which is supported at the open mouth so as to freely turn over. The connection surfaces of the terminals are provided in the same plane at a time of insertion of the terminals into the housing so as to be parallel to each other with certain intervals.

It is desirable that the connector of this type is smaller than ever before, while it has as many terminals as possible. Since the terminals are flat-shaped, shortening the intervals between the terminals can attain high-density arrangement of the terminals and a small size of the connector. However, although a small connector can be made from the point of view of the manufacturing, the connection surfaces are so close each other that there is a problem of short-circuit by a flow of soldering paste in use.

SUMMARY OF THE INVENTION

Accordingly, it is an object of the present invention to provide a compact electrical connector for a circuit board without such problems as described above, thereby enabling higher density arrangement of the terminals.

According to the present invention, a plurality of flat-sheet terminals are held in corresponding receiving slots of a housing in a direction parallel to its sheet surface of the terminal. Each terminal has a contact section to contact with a flat cable and a connection section to connect with a corresponding circuit section of a circuit board. The plurality of terminals are arranged in a direction perpendicular to the sheet surface, being parallel to each other, while their connect sections are faced to the same side. The housing has an open mouth to insert and place the flat cable onto the connection section of the plurality of the terminals at an opposite side of the housing to the connection section, and a movable member which is movably supported at the open mouth to press the flat cable towards the contact sections.

In the electrical connector for a circuit board of the present invention, the connection section is formed as an end section of the terminal, protrudes outward from a bottom surface of the housing, and has a connection surface to contact with the circuit section by its surface. The connection surfaces of the adjacent terminals are provided to be staggered in the receiving direction of the terminal to the housing.

According to the present invention, the connection surfaces of adjacent terminals are provided to be staggered in the receiving direction of the terminal, so that each interval between the connection surfaces of adjacent terminals in the same alignment line are at least twice longer than the one between the adjacent terminals. As a result, soldering of the connection section onto the circuit board can be done without problems in spite of the high-density arrangement of the terminals.

According to the present invention, it is desirable that the connection surfaces of the adjacent terminals are staggered without any overlapping between the adjacent contact surfaces. Even if the connection surfaces are staggered with some overlapping between the adjacent contact surfaces, problems related to a flow of soldering paste can be lessened. However, to certainly prevent the problems related to the soldering flow, the connection surfaces are preferably staggered without any overlapping between the adjacent connection surfaces.

The plurality of the terminals can be comprised of different types of terminal groups, and the terminals of a first terminal group and terminals of a second terminal group can be alternately staggered in a receiving direction of the terminal. Thus, even if all the terminals of the first and second terminal groups are inserted to the same receiving position in the receiving direction, or even if the contact sections are provided at the same position, adjacent connection surfaces can be shifted with certain intervals in the receiving direction as long as the connection sections are shifted.

Moreover, according to the present invention, the connection section of the terminal of at least one of the terminal groups can be at least partially held in the housing, and the connection surface which is an end surface of the connection section can be designed to expose outside of the bottom surface of the housing. By doing this, the connection section which is partially held in the housing can be more firmly retained to the housing, and simultaneously the connector can be smaller in the receiving direction of the terminal for the size of the portion of the connection section held in the housing.

Even if the connection section is in the housing, the connector can connect with a circuit board as long as the connection surface is exposed to outside of the housing.

The different types of terminal groups are desirable to have the same distance between the contact section and the connection section. In this case, electrical lengths (signal transmission lengths) are the same among those terminals, so that the electrical properties and transmission time of signals are not fluctuated, especially on high-speed transmission.

DESCRIPTION OF THE PREFERRED EMBODIMENTS

Figure 1A:
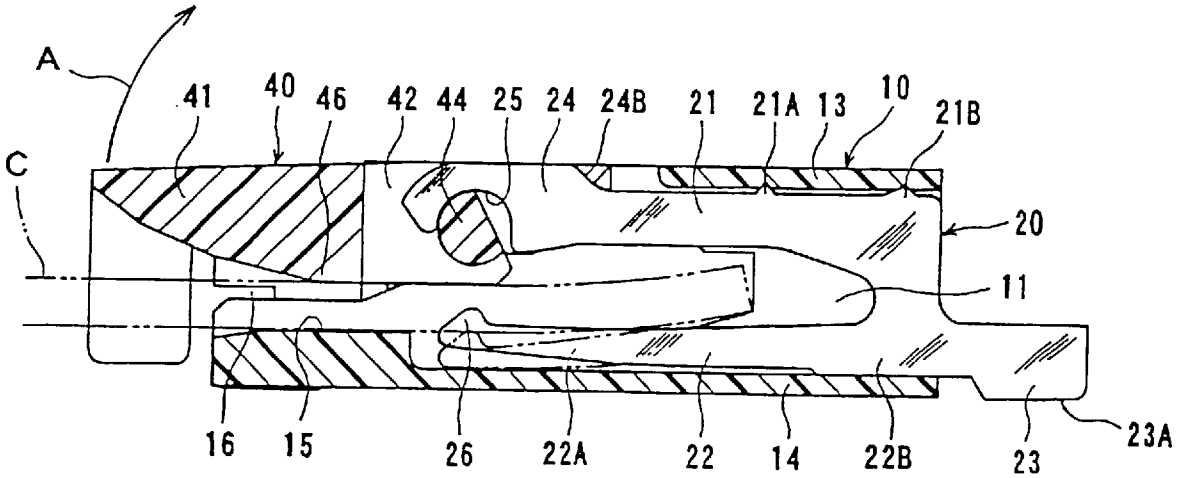
FIG. 1(A) is a sectional view, taken along a terminal, of a connector according to an embodiment of the present invention.

In the first embodiment of the present invention illustrated in FIGS. 1(A) and (B), an electrical connector for a flat cable has a housing which has two types of terminals 20 and 30. See FIG. 1(A) for the terminal 20, and FIG. 1(B) for the terminal 30. The terminals 20 and 30 are made by stamping a metal sheet or the similar method, maintaining its flat surfaces, and are arranged in a manner that two types of terminals 20 and 30 are alternately provided with certain intervals in a direction perpendicular to the paper surface of the figure. The terminals 20 and 30 are pressed into corresponding receiving slots in the housing, which are arranged parallel to the paper surface of the figure.

As FIG. 1(A) shows, the first type of the terminals 20 has an upper arm (supporting arm) 21, a lower arm 22 and a connection section 23 from which the upper arm 21 and the lower arm 22 extend forwardly along the inner surfaces of an upper wall 13 and a lower wall 14 of the corresponding receiving slot 11. The connection section 23 protrudes rearwardly from the lower wall 14 or rightwardly in the figure. The upper arm 21 has engaging protrusions 21A and 21B at an upper edge of its base area, which prevent sliding out of the terminal from the housing by engaging the inner surface of the upper wall 13 of the housing 10 when the terminal 20 is inserted from right side to a predetermined position. The upper arm 21, which is relatively rigid to a deflection in a paper surface of the figure, is more rigid than the lower arm 22. An end section 24 of the upper arm 21 is enlarged in its height direction, and its upper edge 24A is positioned higher (outward) than a lower (inner) surface of the upper wall 13 of the housing 10. Also, a transitional section from the upper edge 24A to an intermediate portion of the upper arm 21 has a shoulder 24B with gentle slope.

The end section 24 of the upper arm 21 has a semi-circular bearing section 25 at its lower edge. The bearing section 25 rotatably supports a movable piece, as described below, and work as a bearing. Since the upper edge 24A is upward from the lower surface of the upper wall 13 of the housing 10 and extends to proximity of the upper surface of the housing, the distance between the bottom of the bearing section 25 and the upper edge 24A is so large that the area around this section is strong.

The lower arm 22 of the terminal 20 is narrower than the upper arm 21, and is deflectable in a plane parallel to the paper surface of the figure. A lower edge of the lower arm 22, especially a portion close to its end has an upward inclination 22A. In addition, the lower arm 22 has a contact section 26 at its free end, which protrudes towards the bearing section 25 of the upper arm 21. A base section 22B of the lower arm 22 is pressed into the inner surface of the lower wall 14 of the housing 10, so that the engaging protrusions 21A and 21B of the upper arm 21 are pressed towards the upper wall 13 by a reaction force from the lower wall 14. Accordingly, it is preferable that the engaging protrusions 21A and 21B are located above the base section 22B, and it is further preferable that the engaging protrusions 21A and 21B are directly above the base section 22B without being offset from the base section 22B.

The connection section 23 of the terminal extends rearwardly from the base section 22B of the lower arm 22 to outside of the housing. A lower edge surface of the connection section 23 protrudes slightly downward from a bottom surface of the housing 10 and forms a connection surface 23A. When the housing 10 is put on a predetermined position of a circuit board (not illustrated), the connection surface 23A is to be placed onto a corresponding circuit section of a circuit board, and connected to the circuit section by soldering. The second type of the terminal 30 also has an upper arm 31, a lower arm 32 and a connection section 33, which are similar to the first type of the terminal 20, but are slightly different in their forms.

The upper arm 31 also has a bearing section 35 at its end, but it is not semi-circular groove, like the bearing section 25 of the first type of terminal 20, but just has a round end. In addition, two engaging protrusions 31A and 31B of the upper arm 31 are provided further inward of the housing, that is, leftward in the figure, in comparison with the upper arm 21 of the terminal 20, due to the relationship with the lower arm 32 as described below. The lower arm 32, which is deflectable, is made longer than the lower arm 22 of the terminal 20, and has a contact section 36 at its free end, which protrudes upward. A base section 32B of the lower arm 32 is provided leftward from the base section 22B of the terminal 20, so that the engaging protrusions 31A and 31B are arranged in a corresponding range to the base section 32 in a lateral direction in the figure.

A connection section 33 of the terminal 30 is provided in the housing 10. The lower wall of the housing, which is also a lower edge of the receiving slot 12, has a cutting 14A at its right end, and the connection section 33 is placed within a range of the cutting 14A. Similar to the terminal 20, a lower edge of the connection section 33 forms a contact section 33A, and the connection section 33A slightly protrudes downward from the bottom surface 14B (lower surface of the lower wall 14) of the housing 10.

Figure 1B:
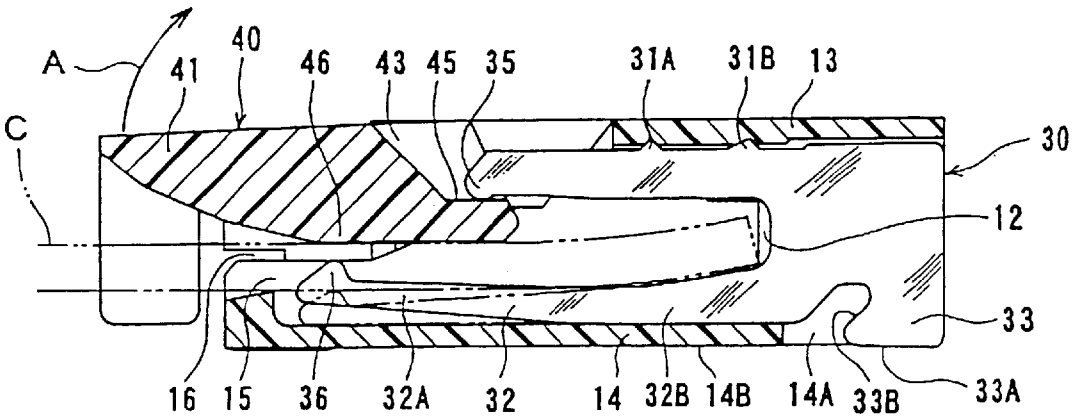
FIG. 1(B) is a sectional view of the connector taken along the adjacent terminal.

The connection section 33 is shaped with a notch 33B which inclines at an acute angle to the connection surface 33A. Since the connection section 33 of the terminal 30 is in a slit-shaped receiving slot which is parallel to the sheet surface of the figure, a flux of soldering paste tends to flow into a space between the connection section 33 and the receiving slot 12 due to capillary phenomenon at a time of soldering at the connection surface 33A. It is not desirable that the flux reaches the contact section 36. To solve this problem, as FIG. 1(B) shows, the notch 33B is inclined with an acute angle in rightward in the figure so as to be away from the contact section 36. Accordingly, even if the flux elevates, it would not reach the contact section. Since the connection section 33 is in the housing 10, it is difficult to see the elevated flux but, even in this case, soldering can be done without concern because the elevated flux has no influence upon the contact section.

Figure 2:
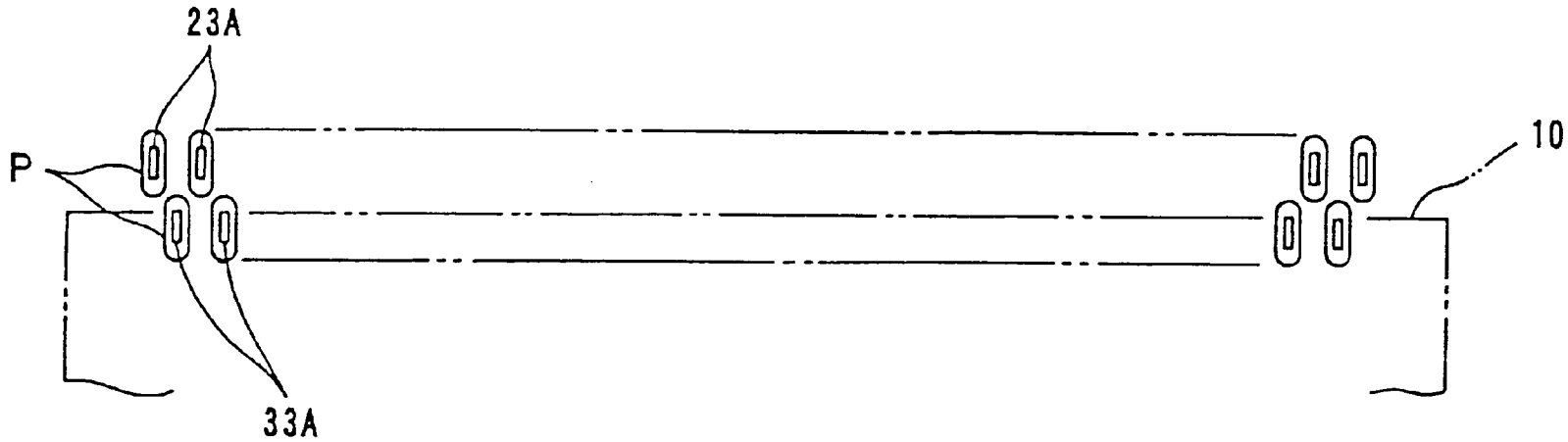
FIG. 2 is a bottom view of part of the connector showing the connection surfaces of the terminals of FIG. 1.

Consequently, the connection surfaces 23A and 33A of the terminals 20 and 30, which are alternately provided in arranging direction, are staggered in a connection surface plane as shown in FIG. 2. Thus, the connection surfaces 23A and 33A are arranged corresponding to the circuit sections P which are similarly staggered on the circuit board.

In the connector illustrated in FIGS. 1(A) and (B), the different types of terminals 20 and 30 are alternately provided, and the contact sections 26 and 36 are in different positions in the height direction in the figure so that they are arranged in a zigzag fashion in its plan view. This is preferable to contact with a flat cable in broad area. However, in the case of a high-speed transmission, it is not preferable if the distance between the contact section 26 and the connection section 23 of the terminal 20 is different from the one between the contact section 36 and the connection section 33 of the terminal 30, because the difference of electrical lengths (signal transmission lengths) causes degradation of the electrical characteristics and fluctuation of the transmission time. In the example illustrated in the figure, distances between the contact section and the connection section are designed not to be different between the two types of the terminals, by shifting the contact section 26 or 36 for a distance equivalent to the shifted length between the connection sections 23 and 33.

As described above, the housing 10 has slit-shaped receiving slots 11 and 12 to insert the terminals 20 and 30 which are made from a metal sheet maintaining its sheet surfaces. The receiving slots are alternately provided as many as the number of each type of the terminals, being parallel to the sheet surface of the figure. The upper wall 13 and the lower wall 14 of the housing 10, which form the upper and the lower edges of the receiving slots 11 and 12, define inserting positions of the terminals 20 and 30. The base sections 22B and 32B of the lower arms 22 and 32 contact with the inner surface of the lower wall 14 and, as described above, the engaging protrusions 21A, 21B; 31A, 31B of the upper arms 21 and 31 secure the positions of the terminals and prevent sliding out of the terminals 20 and 30 from the housing 10 by engaging the upper wall of the housing 10.

The housing 10 has at least one cable slot 15 to insert a flat cable C into the housing 10 from left side. The cable slots 15 are provided so as to be communicatively connected across the plurality of the receiving slots 1 and 12 between the upper and lower walls in a range substantially equal to the width of the flat cable C (dimension in a direction perpendicular to the sheet surface of the figure), that is, the width of arrangement of the both types of terminals.

Also, the housing 10 has an open mouth 16 which is open above the cable slots 11 and 12 up to the front end of the upper wall 13 of the housing 10 and extends downwardly to the cable slot 15.

The open mouth 16 of the housing 10 has a movable member 40 made from an insulating material. The movable member 40 is supported by the bearing sections 25 and 35 for rotation between a closed position, which is illustrated in FIGS. 1(A) and (B), and an open position where the movable member 40 is turned over for a predetermined angle from the closed position in a direction of an arrow A in the figures. The movable member 40 has an operating section 41 at its front and a plurality of slots 42 and 43 at the rear end. The operating section 41 is used to give a rotational force to the movable member 40. The slots 42 and 43 receive the front end section of the upper arms 21 and 31 of the terminals 20 and 30 and have a slit-shape which corresponds to the shape of each upper arm 21; 31. The slots 42 and 43 are alternately provided so as to form a comb-like shape. A shaft portion 44 is provided in the slot 42 and is rotatably supported by the bearing section 25, while a straight section 45 is provided so as to contact with the bearing section 35 for rotation.

The connector of the present invention is used in the following manner:

(1) First, place the connector to a predetermined position on a circuit board (not illustrated), and connect the connection sections 23 and 33 of the terminals 20 and 30 to each corresponding circuit section P of the circuit board at connection surfaces 23A and 33A. In this case, as apparent from FIG. 2, since adjacent connection surfaces 23A and 33A of two types of terminals 20 and 30 are shifted in the vertical direction, soldering can be done with the interval of adjacent connection surfaces 23A or 33A of the same type of the terminals. That is, soldering can be done with the distance twice as long as the interval between the adjacent different types of terminals 20 and 30. Thus, even when the terminals 20 and 30 are arranged in high density, there is no concern of a short-circuit due to the flow of soldering paste.

(2) Then, turn the movable member 40 in the direction A to the open position.

(3) When the movable member 40 is at the open position, the open mouth 16 is opened widely at the left-hand side. Accordingly, it is easy to see an entrance (inserting space) of the cable slot 15 from the inserting side of a flat cable C. At this point, insert the flat cable C to the cable slot 15, with the connection side facing down, until the front end of the cable C contacts with the deepest wall of the cable slot 15.

(4) Once the cable is inserted to the predetermined position, turn the movable member 40 in the opposite direction to the arrow A over to the closed position as illustrated in FIGS. 1(A) and (B). Consequently, the movable member 40 presses the flat cable C at its pressuring section 46 towards the contact sections 26 and 36 of the terminals 20 and 30 to connect them electrically.

Figure 3A:
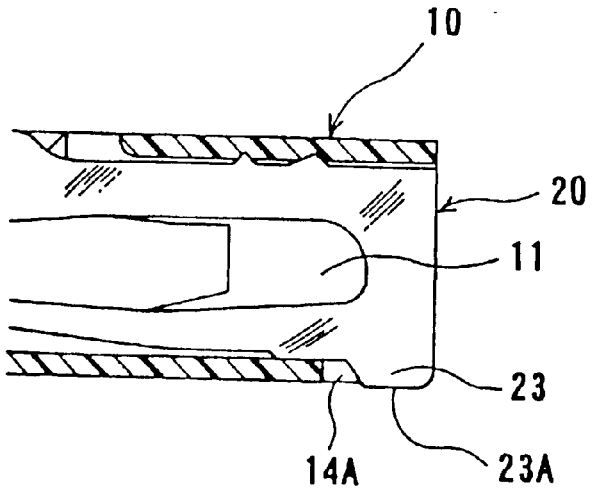
FIG. 3(A) is a sectional view, taken along a terminal, of a connector according to another embodiment of the invention.
Figure 3B:
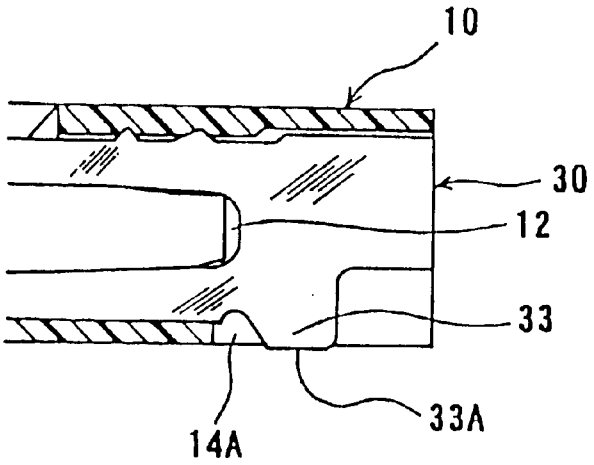
FIG. 3(B) is a sectional view, taken along the adjacent terminal, of the connector of FIG. 3(A).

The present invention is not limited to the embodiment illustrated in FIG. 1 and, for an example, the connection sections 22 and 33 of the two types of terminals 20 and 30 can be provided in different positions from FIG. 1 in the receiving direction of the terminals. In FIGS. 3(A) and (B), both the connection sections 23 and 33 of the terminals 20 and 30 are provided inside the housing 10. The lower walls 14 of the receiving slots 11 and 12 of the housing 10 have openings 14A, like the one illustrated in FIG. 1(B). Also in this case, the connection surface 33A is located at a shifted position in comparison with the connection surface 23A in the receiving direction of the terminal, so that the opening 14A for the connection surface 33A is provided also in a shifted position corresponding to the shift between connection sections 23 and 33. By doing this, when the connection sections 23 and 33 are put into the housing, the connection sections 23 and 33 can be securely retained and firmly supported by the side faces of the receiving slots 11 and 12, and simultaneously the size of the connector can be made smaller in the receiving direction of the terminal.

Figure 4A:
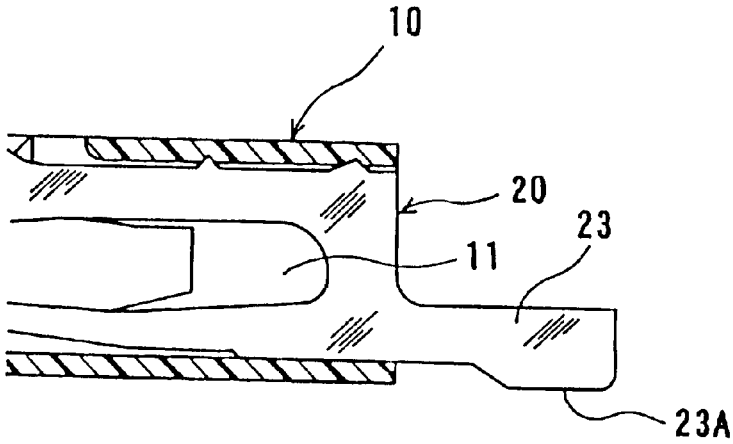
FIG. 4(A) is a sectional view, taken along a terminal, of a connector according to still another embodiment of the invention.
Figure 4B:
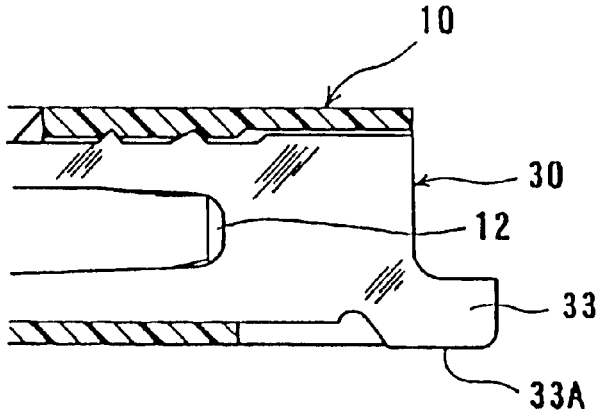
FIG. 4(B) is a sectional view, taken along the adjacent terminal, of the connector of FIG. 4(A).

The above-described effects are partially attained even if the whole connection sections are put into the housing. For an example, in FIG. 4(A), the terminal 20 is the same as the terminal 20 of FIG. 1(A), while a part of the connection section 33 of the other terminal 30 is held in the housing 10 while the rest of the connection section 33 protrude outside the housing 10, as illustrated in FIG. 4(B). By doing this, the connection section 33 is retained with a retaining power lower than that of FIG. 1(B) but still retained firmly, and it is easier to check the soldering for the portion of the connection section which is outside of the housing. Also, the position of the connection sections can be precisely controlled.

Figure 5A:
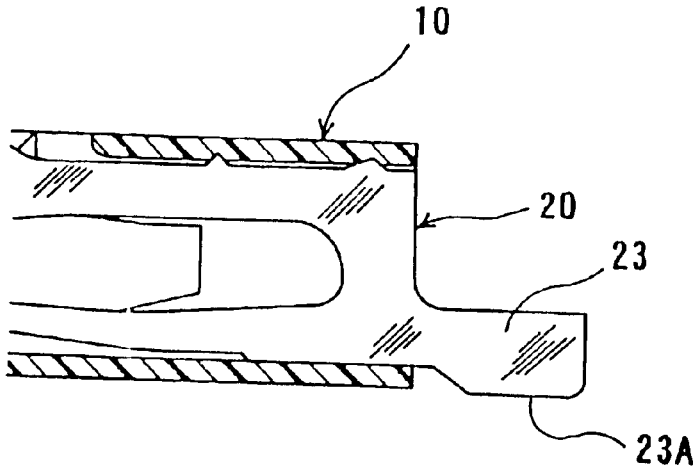
FIG. 5(A) is a sectional view, taken along a terminal, of a connector according to yet another embodiment of the invention.
Figure 5B:
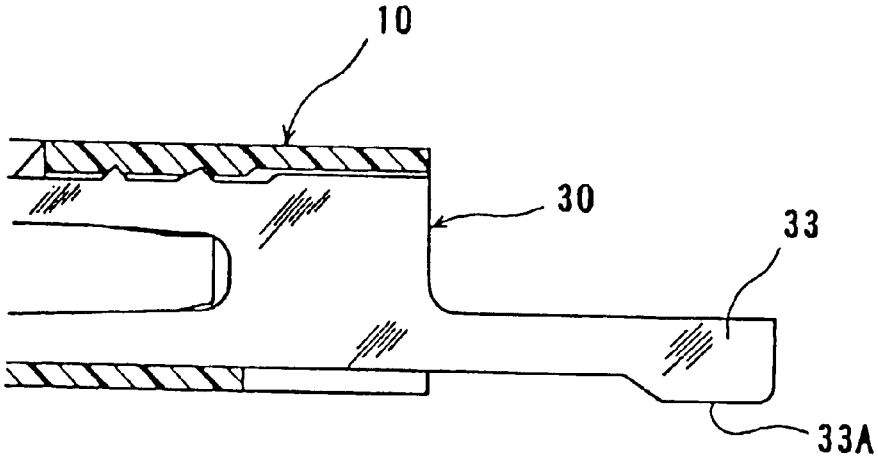
FIG. 5(B) is a sectional view, taken along the adjacent terminal, of the connector of FIG. 5(A).

In FIGS. 5(A) and (B), the connect sections 23 and 33 of the both terminals 20 and 30 are provided outside of the housing 10. In this case, the size of the connector is larger than the above examples in the receiving direction of the terminals, and the connection sections are not firmly supported by the receiving slots, but it is much easier to check the soldering. This is suitable where there is an enough space around the connector on the circuit board.

Furthermore, the present invention is not limited to the case of two types of the terminals, and can have more than tree types of terminals. Where the connector has only one type of the terminal, this can be coped by shifting the receiving positions of the adjacent terminals inside the housing. In either case, there is no problem as long as the connection surfaces of the adjacent terminals are staggered in the receiving direction with or without overlapping the adjacent connection surfaces. Also, the present invention does not limit the form of the movable member 40. That is, the movable member 40 can be the rotationally movable type, like the one illustrated in the figures, or can be a linearly movable type.

According to the present invention, the connection surfaces, which are formed at the ends of the sheet-type terminals, are staggered in the receiving direction of the terminals into the housing, so that the intervals between the adjacent contact surfaces in a direction perpendicular to a sheet surface of the figures is wide enough to prevent problems related to connection of the connector with the circuit board by soldering where a plurality of the terminals are arranged with high density; therefore the smaller connector can be made by arranging the terminals in high density.

What is claimed is:

1. An electrical connector for a circuit board, comprising:

a housing having a plurality of parallel receiving slots extending forwardly from its rear face and an open mouth extending rearwardly from its front face for receiving a flat cable, a plurality of flat terminals inserted into said receiving slots and having front contact sections at their front ends for contact with said flat cable and rear connection sections extending rearwardly for connection with circuit sections of said circuit board, said terminals including two types of terminals that are arranged alternately in said receiving slots, a movable member provided at said open mouth for pressing said flat cable against said contact sections in said open mouth, said connection sections of adjacent terminals having connection surfaces for connection with said circuit sections that are staggered in an insertion direction of said terminals into said receiving slots, at least part of connections sections of one type of said terminals is held in said housing, wherein all of said terminals have substantially the same distance between said contact sections and said connection sections.

2. An electrical connector for a circuit board, comprising:

a housing having a plurality of parallel receiving slots extending forwardly from its rear face, an open mouth extending rearwardly from its front face for receiving a flat cable, and at least one slot at its rear bottom face, a plurality of flat terminals inserted into said receiving slots and having front contact sections at their front ends for contact with said flat cable and rear connection sections extending rearwardly for connection with circuit sections of said circuit board, at least one of said connection sections being placed within a range of said slot, a movable member provided at said open mouth for pressing said flat cable against said contact sections in said open mouth, said connection sections of adjacent terminals having connection surfaces for connection with said circuit sections that are staggered in an insertion direction of said terminals into said receiving slots and at least part of said connection sections of said terminals being held in said housing, wherein at least one of said connection sections of said terminals has a notch in said cutting.

3. The electrical connector according to claim 2, said notch is inclined with an acute angle so as to be away from said contact section.

* * * * *